US005425244A

United States Patent [19]

Vaynberg

[11] Patent Number: 5,425,244

[45] Date of Patent: Jun. 20, 1995

[54] DOUBLE CIRCUITED EVAPORATOR COOLING SYSTEM AUTOMATICALLY CONFIGURABLE TO OPERATE IN CASCADE OR SINGLE COMPRESSOR MODE

[75] Inventor: Mikhail M. Vaynberg, San Francisco, Calif.

[73] Assignee: Reefco Manufacturing Corporation, Mill Valley, Calif.

[21] Appl. No.: 153,673

[22] Filed: Nov. 16, 1993

[51] Int. Cl.[6] ..... F25B 7/00

[52] U.S. Cl. ..... 62/175; 62/335

[58] Field of Search ..... 62/335, 175, 79

[56] References Cited

U.S. PATENT DOCUMENTS

| | | | |
|---|---|---|---|
| 2,434,221 | 1/1948 | Newton | 62/335 X |
| 2,796,743 | 6/1957 | McFarlan | 62/335 |
| 2,968,933 | 1/1961 | Pfeifer et al. | 62/176 |
| 2,984,084 | 5/1961 | Talmey et al. | 62/239 |
| 3,386,260 | 6/1968 | Kirkpatrick | 62/239 |
| 3,572,052 | 3/1971 | Toth | 62/278 |
| 3,733,849 | 5/1973 | Cantagallo et al. | 62/414 |
| 4,691,527 | 9/1987 | Ikeda | 62/234 |
| 5,187,945 | 2/1993 | Dixon | 62/234 |

FOREIGN PATENT DOCUMENTS

| | | | |
|---|---|---|---|
| 0282744 | 9/1990 | German Dem. Rep. | 62/335 |

OTHER PUBLICATIONS

York Transportation Equipment Service and Parts Manual Model TNE 256 NL, p. 9, FIG. 3.

York Transportation Refrigeration and Air Conditioning Equipment Twin-Pak TNE-255 Sales Brochure.

Billy C. Langley, "Heating, Ventilating, Air Conditioning, and Refrigeration", pp. 56–58, Prentice-Hall, Inc. 1990.

Robert Chatenever, "Air Conditioning and Refrigeration for the Professional", pp. 171–174, John Wiley & Sons, Inc. 1988.

Roy J. Dossat, "Principles of Refrigeration", Third Edition, pp. 476–483, Prentice-Hall, Inc. 1991.

Andrew D. Althouse, Carl H. Turnquist, Alfred F. Bracciano, "Modern Refrigeration and Air Conditioning", The Goodheart-Wilcox Company, Inc. 1992, pp. 75–99.

Coldwrap Sea Containers Inc., "The Story of Our New Rent-A-Container Is A Lot Of Cold Air.", Sales Brochure.

"1990 ASHRAE Handbook Refrigeration Systems and Applications", American Society of Heating, Refrigerating and Air Conditioning Engineers, Inc., pp. 28.1–30.16.

"ASHRAE Handbook 1982 Applications", American Society of Heating, Refrigerating and Air Conditioning Engineers, Inc., pp. 43.1–45.18.

"1986 ASHRAE Handbook Refrigeration Systems and Applications", American Society of Heating, Refrigerating and Air Conditioning Engineers, Inc., pp. 28.1–30.18.

Thermo King Sales Brochure for Models SB-III & SB-III MAX.

*Primary Examiner*—William E. Wayner

*Attorney, Agent, or Firm*—Haverstock, Medlen & Carroll

[57] ABSTRACT

A broad range cooling system is provided which can operate over a temperature range of −25° F. to 75° F. under any expected ambient temperatures. The system includes two compressor systems which are configurable to operate independently, or as a cascade system, depending upon the desired temperature requirements of the load in relation to the ambient. There are two separate evaporator systems for cooling air which is used to cool the product; one evaporator system for each compressor. In single compressor mode, the selected compressor is used to cool its respective evaporator system and each compressor system is automatically configured to utilize the primary condenser to convert hot gas to a liquid. In cascade cooling mode, the lower compressor system is automatically reconfigured to utilize an evaporator side of a heat exchanger to convert hot gas to a liquid and to utilize the primary condenser to evaporate the liquid to a cold gas while absorbing heat. The upper cascade compressor system is automatically reconfigured to use the primary condenser to convert hot gas to a liquid and to use its respective evaporator for cooling the load. In the event of a failure of one or the other compressor, the system is configured to continue operation with the other compressor until a repair can be affected.

10 Claims, 5 Drawing Sheets

USER INTERFACE
CONTROLLER
AMBIENT TEMPERATURE SENSOR
SOLENOIDS
T1
701
700
702

SEE FIG. 1A

DOUBLE CIRCUITED EVAPORATOR COOLING SYSTEM AUTOMATICALLY CONFIGURABLE TO OPERATE IN CASCADE OR SINGLE COMPRESSOR MODE

FIELD OF THE INVENTION

This invention relates to the field of cooling systems. More particularly, this invention relates to the field of cascade refrigeration systems.

BACKGROUND OF THE INVENTION

Single compressor systems are well known for cooling. Such systems are commonly used in refrigerated containers for trucks, rail and shipboard transportation of food products. Note however, that the present invention is not restricted to transportation applications of refrigerated container.

Single compressor containers are unequal to certain cooling tasks. For example, once produce is picked it is desirable to immediately reduce its temperature to prevent spoiling. During hot summer months, shippers of produce transport the produce to a cold storage warehouse to bring the produce down to temperature before loading onto a refrigerated container which merely operates to maintain the temperature of the precooled produce are incapable of bringing the produce to temperature quickly enough. The ability of such transportation devices to cool a hot load of produce in a sufficiently short time to prevent spoilage does not exist in commercially-available containers.

Most commercially-available refrigerated containers for transportation are single compressor systems. Generally, single compressor systems are inadequate for cooling a load below about −20° F. Some commercially-available refrigerated containers having single compressor systems can cool a load to about 0° F. Unfortunately, purchasers of refrigerated containers desire a device which can maintain a load at −20° F. and lower at ambient temperatures up to +150° F.

By way of example, consider a single compressor system for cooling a load to −20° F. in an ambient environment of +150° F. The evaporator temperature necessary to maintain the load at a predetermined temperature is at the best 10° F. colder than the load. Here the evaporator is cooled to −30° F. Under these conditions using R12, the evaporator pressure is expected to be approximately 9 psi and using R22, the expected pressure is approximately 20 psi. Similarly, the condenser temperature necessary to discharge heat to the ambient is 10° to 40° warmer than the ambient under the best case conditions; thus, in this example, the condenser is at 160° F. The pressure in the condenser under these conditions is expected to be approximately 278 psi for R12 and 445 psi for R22.

The conditions in the example of the previous paragraph dictate a compression ratio of $278/9 \approx 31$ for R12 and $445/20 \approx 22$ for R22. Refrigeration transportation containers are designed to operate with a compression ratio no greater than 15. If the pressure ratio exceeds the manufacturer's design criteria the compressor will break. Accordingly, neither example above could be achieved with a conventional single compressor system. Indeed, a commercially available compressor is not available with the capacity to operate in a refrigerated container environment under the above conditions and accordingly, such a system in a refrigerated container would be prohibitively expensive and inefficient. Thus, commercially available single compressor systems are incapable of operating where the difference between the desired product temperature and the actual ambient temperature is very large as in these examples.

Cascade systems are well known. It is well understood in cascade systems that heat from a lower cascade compressor is removed by the evaporator of a high cascade compressor system; and heat from the high cascade system is dissipated into the ambient. The pressure ratio for the cascade system is the product of the pressure ratio for both the low cascade compressor system and the high cascade compressor system. A cascade system for the R22 example described above would also have a pressure ratio of approximately 22 and it could have both the low and high cascade compressor systems operating at the same pressure ratios, i.e., both pressure ratios at approximately 4.7 for each compressor. This pressure ratio is well within an acceptable range of the specifications of commercially available compressors.

Cooling systems require a minimum pressure ratio to operate. If the necessary pressure ratio becomes too small the compressor will fail. As the difference between the product temperature and the ambient temperature is reduced, the pressure ratio for a cooling system is also reduced. When using a cascade cooling system, as the difference between these temperatures becomes smaller, the pressure ratio for both compressor systems will fall below the minimum pressure ratio necessary for operation sooner than a system using a single compressor.

Conventional cascade systems use different refrigerants, one for each compressor in each system. This requires the system designer to uniquely design the low cascade compressor system and the high cascade compressor system. Commonly used refrigerants are 502 and R12. To protect the environment, these refrigerants will be banned after 1995. The refrigerant R22 is far less damaging to the environment than 502 or R12 and as such is not scheduled to be banned until 2020.

What is needed is a cooling system for cooling a load of product to a desired temperature which can efficiently operate over a broad range of ambient temperatures, e.g., −60° F. to +150° F. and load temperatures from −25° F. to +75° F.

SUMMARY OF THE INVENTION

A broad range cooling system is provided which can operate over a temperature range of −30° F. to 75° F. in the container under any expected ambient temperatures. The system includes two compressor systems which are configurable to operate independently, or as a cascade system, depending upon the desired temperature requirements of the load in relation to the ambient temperature. There are two separate evaporator systems for cooling air which is used to cool the product; one evaporator system for each compressor. In single compressor mode, the selected compressor is used to cool its respective evaporator system and each compressor system is automatically configured to utilize the primary condenser to convert hot gas to a liquid. In cascade cooling mode, the lower cascade compressor system is automatically reconfigured to utilize the condenser side of the heat exchanger to condense the hot gas of the lower cascade system to a liquid or in a single compressor mode to utilize its evaporator system to evaporate the liquid to a cold gas while absorb heat.

The upper cascade compressor system is automatically reconfigured to use the evaporator side of the heat exchanger to convert hot gas to a liquid and to use its respective evaporator for cooling the load. In the event of a failure of one or the other compressor, the system is configured to continue operation with the other compressor until a repair can be affected.

DETAILED DESCRIPTION OF THE PREFERRED EMBODIMENT

Figure 1A:
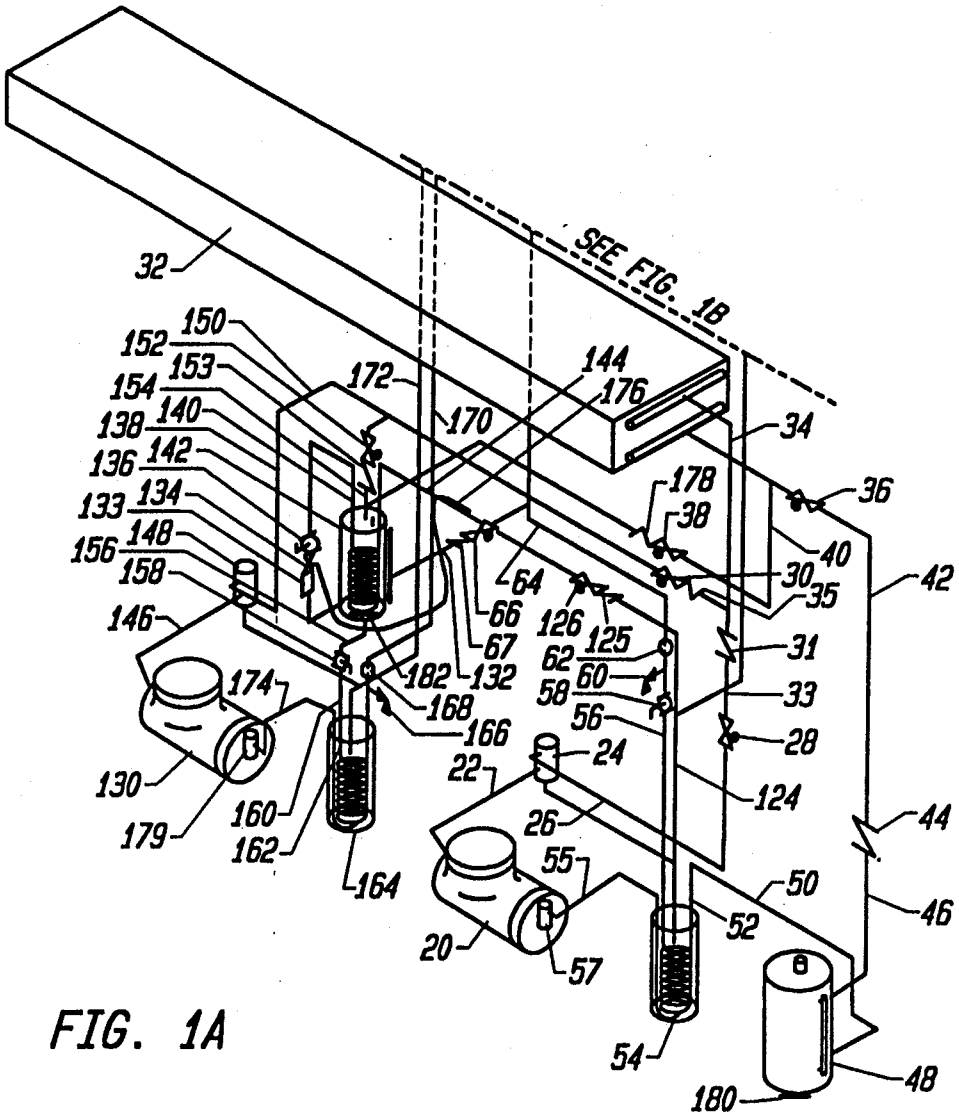
FIG. 1 shows a perspective view of a schematic diagram of an alternate embodiment of a cooling system to achieve the goals of the present invention.
Figures 1B, 1C:
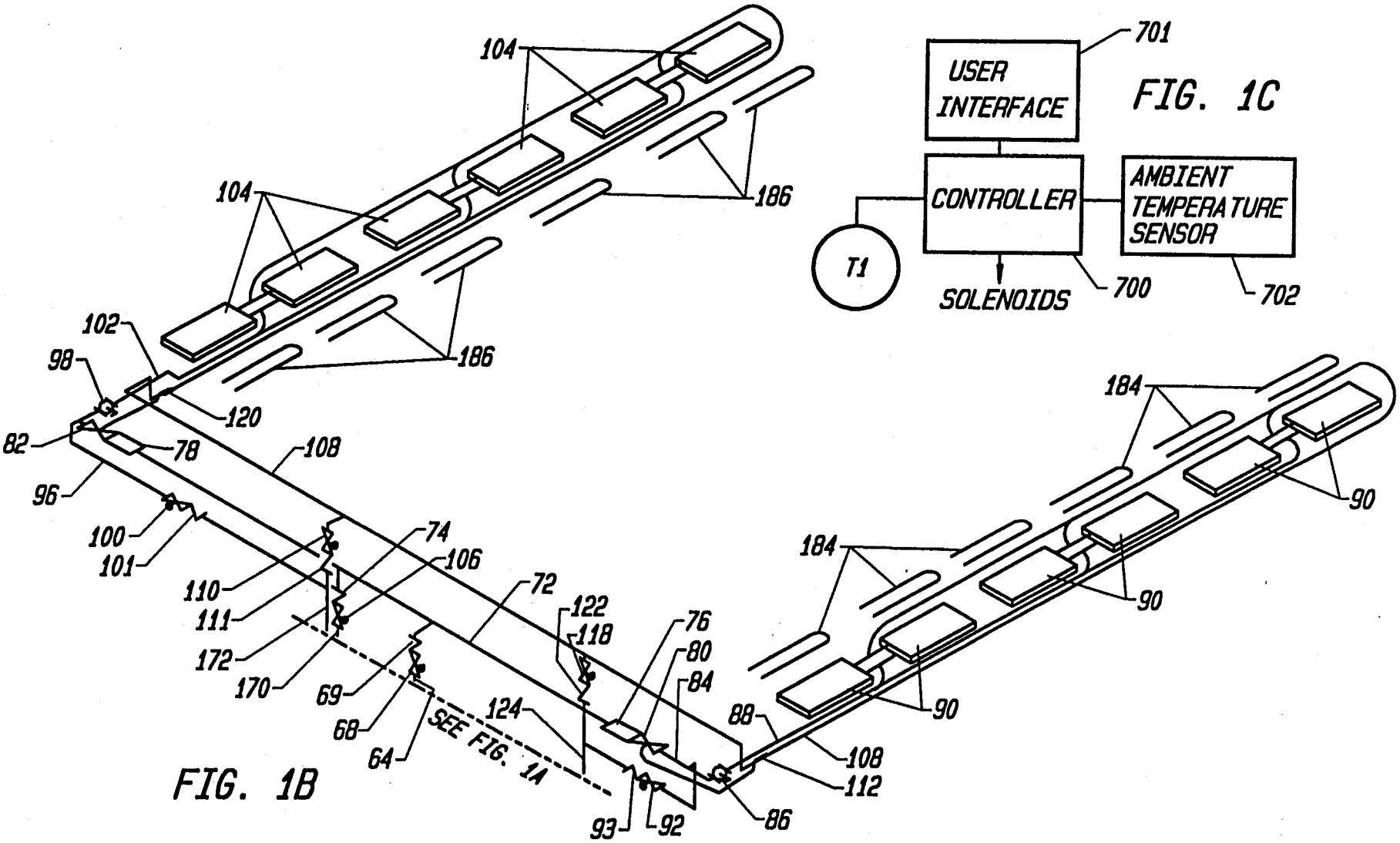

In his co-pending patent application Ser. No. 08/153,173, filed on Nov. 16, 1993 (the same day as this application) the inventor teaches one embodiment, as shown in FIG. 1, of a broad temperature range cooling system is provided which can operate over a load temperature range of −25° F. to 75° F. and an ambient temperature range from −60° F. to +150° F. That system is configured to operate as two single compressor systems, each one operating at a time, or as cascade cooling system. If the difference between the desired temperature of the product and the ambient temperature is sufficiently small, the apparatus according to that system can automatically configure itself to operate the smaller or the bigger one of the two compressor systems. The two compressor systems preferably have different compressor capacity to provide an even broader range of cooling control. Either compressor can be used in the single compressor mode. The difference is deemed sufficiently small if the pressure ratio would be too small to operate effectively if that system were configured in cascade mode.

If the difference between the set temperature of the product and the ambient temperature is sufficiently large, the apparatus can automatically configure the system to operate in the cascade mode. The difference is deemed large if the pressure ratio when operating in single compressor mode would exceed the acceptable specifications. Because either compressor can be configured to provide liquid to the evaporators, and because each compressor has its own supply of refrigerant, that system includes means for draining the refrigerant from the evaporators prior to releasing control of the evaporator.

In the event that the system is operating as a single cooling system using only the compressor 20, the compressor 20 compresses the gas into the hot gas line 22 which is applied to the oil separator 24. Up to 98% of the oil that is present in the compressed gas is separated from the gas in the oil separator 24, and the gas is applied to the hot gas line 26. The hot gas line 26 is coupled to a hot gas solenoid 28 which is open. The hot gas solenoid 28 is coupled to check valve 31 via a hot gas pipe 33. The check valve 31 is coupled to a check valve 35 and to a condenser 32 via a hot gas "Y" pipe 34. The check valve 35 is coupled to a hot gas solenoid 30 which is closed. For the purposes of this specification, a "Y" pipe is defined as a pipe that is plumbed to couple more than two elements on the cooling circuit to one another.

The hot gas gives up heat to the air and condenses to a liquid in the condenser 32. The output of the condenser is coupled to two liquid solenoids, 36 and 38, via the liquid "Y" pipe 40. The liquid solenoid 38 is closed, and the liquid passes through liquid solenoid 36 into the liquid pipe 42 to a check valve 44. A liquid pipe 46 is coupled between the output of the check valve 44 and the input of a linear receiver 48.

The output of the linear receiver 48 is coupled to the input of a coil 52 of a suction accumulator 54 via a liquid pipe 50. The output of the coil 52 of the suction accumulator 54 is coupled to a liquid pipe 56, which is coupled in turn to a ball valve 58. The output of the ball valve is coupled to a charge valve 60 which in turn is coupled to a sighting glass 62. The output of the sighting glass 62 is coupled to a liquid "Y" pipe 64, which in turn is coupled to two liquid solenoids 66 and 68.

In the single compressor mode, the liquid solenoid 66 is closed, and the solenoid 68 is open. The output of the liquid solenoid 68 is coupled to a check valve 69 which in turn is coupled to a liquid "Y" pipe 72, which in turn is coupled to a check valve 74, and two filter/dryers 76 and 78. The check valve 74 is coupled to a solenoid 106. The filter/dryer 76 is coupled to a thermostatically controlled thermal expansion valve 80 and the filter/dryer 78 is coupled to a thermostatically controlled thermal expansion valve 82.

The output of the thermal expansion valve 80 is coupled to a liquid "Y" pipe 84, which in turn is coupled to a ball valve 86 and a solenoid 92 which is closed. The output of the ball valve 86 is coupled to a "Y" pipe 88, which in turn is coupled to a plurality of evaporators 90. Similarly, the output of the thermal expansion valve 82 is coupled to a "Y" pipe 96, which in turn is coupled to a ball valve 98 and to a liquid solenoid 100. The output of the ball valve 98 is coupled to a liquid pipe 102, which in turn is coupled to a plurality of evaporators 104. In the single compressor operating mode, the liquid solenoids 74, 92, 100 and 106 are closed.

The liquid in the evaporators 90 absorbs heat wherein it evaporates to a cold gas which returns via the cold gas "Y" pipe 108. The cold gas "Y" pipe 108 is coupled to the cold gas solenoid 110 which is closed, to the cold gas solenoid 118 which is open and to the evaporators 104. A thermostatic bulb 112 of the thermal expansion valve 80 is mounted on the cold gas pipe 108. Similarly, the liquid applied to the evaporators 104 by the liquid pipe 102 evaporates to a cold gas which is coupled to the cold gas solenoid 118 and 110. A thermostatic bulb 120 of the thermal expansion valve 82 is also mounted on the cold gas pipe 108.

For the single compressor operation described above, the cold gas solenoid 110 is closed. The cold gas solenoid 118 is coupled to a check valve 122 which in turn is coupled to a "Y" pipe 124. The "Y" pipe 124 is coupled to the check valves 93 and 125 and to the shell of the suction accumulator 54. The check valve 125 is coupled to the cold gas solenoid 126 which is closed so the gas returns through the shell of the suction accumulator 54 to the cold gas pipe 55, to the suction filter 57 and finally to the compressor 20 where the cycle is complete.

The cooling system, according to FIG. 1, is set up for a refrigerated container having multiple evaporators. Accordingly, two sets of evaporator coils 90 and 104 are simultaneously utilized in that embodiment. It will be apparent to one of ordinary skill in the art that the evaporator coils 104, as well as the liquid solenoid 100, the filter dryer 78, the thermal expansion valve 82, the ball valve 98, the thermostatic bulb 120 and the associated piping can all be eliminated to provide a single evaporator system which can be used as in conventional refrigerated cooling systems.

In order to perform the cascade cooling operation, two compressor systems are provided. Each compressor has its own refrigerant. Preferably both refrigerants are of the same type. Thus, during a switch from a one compressor to a two compressor operation, the refrigerant and the oil from the first compressor system first needs to be removed from the evaporators 90 and 104 so that the refrigerant from a second compressor 130 can be used in the evaporators. This avoids the situation where one of the systems has too much refrigerant and oil and the other too little. The cascade cooling system according to the present invention is designed to use R22 refrigerant in each of the two compressors 20 and 130.

To remove the refrigerant from the evaporators after the system has operated in a single compressor mode using only compressor 20, the liquid solenoids 68 and 118 are closed. The remainder of the solenoids stay in their previous condition as described above. While the compressor 20 still operates, the liquid drain solenoid 92 is opened and the heaters 184 and 186 are energized. The heat from the heaters 184 and 186 boils the refrigerant and oil from the evaporators. The compressor continues to run until a low pressure switch cuts out the compressor which removes essentially all the refrigerant and oil from the system.

Once the evaporators 90 and 104 are cleared of refrigerant and oil, the cooling circuit for the compressor 20 is then conditioned to operate as follows. Hot gas is discharged from the compressor 20 through the hot gas line 22 into the oil separator 24. The hot gas leaves the oil separator 24 via the hot gas line 26 and then through the hot gas solenoid 28. The hot gas is coupled through the hot gas solenoid 28 to the hot gas pipe 33 to the check valve 31. Then, the hot gas is coupled to the hot gas "Y" pipe 34, which in turn is coupled to the hot gas solenoid 30 which is closed through the check valve 35, and to the condenser 32. The gas gives up heat to the air and is converted to a liquid in the condenser 32.

The output of the condenser 32 is coupled to the liquid "Y" pipe 40, which in turn is coupled to the liquid solenoids 36 and 38. The liquid solenoid 38 is closed, and the liquid from the condenser 32 passes through the liquid solenoid 36 into the liquid pipe 42. The liquid then passes through the check valve 44 into the liquid pipe 46, which is coupled to provide the liquid to the linear receiver 48. The liquid passes from the linear receiver 48 into the liquid pipe 50 and into the coil 52 of the suction accumulator 54. The liquid leaves the coil 52 of the suction accumulator 54 through the liquid pipe 56 and passes through the ball valve 58 and the sighting glass 62. A charge valve 60 is coupled to the pipe between the ball valve 58 and the sighting glass 62. The liquid is coupled to the liquid "Y" pipe 64. The solenoid 68 remains closed and the solenoid 66 is opened so that the liquid passes through the solenoid 66, the check valve 67 and into the liquid pipe 132. The liquid is coupled to a filter/dryer 133 which is coupled to a thermostatically controlled thermal expansion valve 134. The liquid passes through the thermal expansion valve 134, through a ball valve 136 and into the liquid pipe 138.

The liquid pipe 138 is coupled to provide the liquid to the coil 140 of a heat exchanger 142. The heat exchanger 142 acts as an evaporator for the liquid which evaporates thereby forming a cold gas within the coil 140. The cold gas is coupled to a cold gas pipe 144, which passes through the now opened cold gas solenoid 126, the check valve 125 and into the cold gas pipe 124. The cold gas solenoids 118 and 92 are closed so the cold gas passes through the shell of the suction accumulator 54, into the cold gas pipe 55, to the suction dryer 57 and from there into the compressor 20.

At the same time the compressor 130 compresses a gas forming a hot gas which is discharged through a hot gas pipe 146 into an oil separator 148. The separated hot gas is discharged from the oil separator 148 into the hot gas "Y" pipe 150. The hot gas "Y" pipe 150 is coupled to the hot gas solenoid 30 and a hot gas solenoid 152. The hot gas solenoid 30 is closed, and the hot gas solenoid 152 is opened, which couples the hot gas through a check valve 153, the hot gas pipe 154, and into the shell of the heat exchanger 142.

Because the heat exchanger 142 acts as an evaporator for the circuit of compressor 20, the hot gas is cooled by the lower compressor circuit to a liquid within the heat exchanger 142. The liquid exits the heat exchanger 142 via a liquid pipe 156, and passes through the ball valve 158. The liquid leaves the ball valve 158 through the liquid pipe 160 into the coil 162 of a suction accumulator 164. The output of the coil 162 of the suction accumulator 164 passes through a sighting glass 168 and into the liquid "Y" pipe 170. A charge valve 166 is coupled to the pipe between the suction accumulator 164 and the sighting glass 168.

The liquid "Y" pipe 170 is coupled to the liquid solenoid 106. The output of the liquid solenoid 106 is coupled to the check valve 74 and then to the liquid "Y" pipe 72. The liquid solenoid 68 is closed so the liquid passes through the filter/dryers 76 and 78, the thermal expansion valves 80 and 82, into the liquid pipe 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174 and back into the compressor 130. A thermostatic bulb 176 of the thermal expansion valve 134 is mounted on the pipe 144.

Operating in this cascade mode, the cooling system of the figure is capable of producing temperatures as cold as −25° F. even when the ambient temperature is as high as 150° F. This is because the hot gas in the cooling system of the compressor 130 is cooled in the heat exchanger 142 which is acting as an evaporator for the cooling system of the compressor 20. Thus, neither compressor need operate at pressure ratios beyond the manufacturer's specifications in order to achieve the necessary cooling.

The system can also operate under a single compressor mode using only the compressor 130. Here, because the refrigerant in the evaporators 90 and 104 is already the refrigerant for the compressor 130, there is no need to clear the refrigerant and oil from the evaporators.

In a single compressor mode of operation using the compressor 130, the hot gas is pumped from the compressor 130 through the hot gas pipe 146 into the oil separator 148. The hot gas leaves the oil separator via the hot gas "Y" pipe 150. The hot gas solenoid 152 is closed, and the hot gas solenoid 30 is open, so the hot gas passes through the hot gas solenoid 30, the check valve 35 and into the hot gas "Y" pipe 34. The hot gas solenoid 28 is closed, so the hot gas passes through the condenser 32 where it gives up heat to become a liquid and then leaves the condenser 32 via the liquid "Y" pipe 40.

The liquid solenoid 36 is closed, and the liquid solenoid 38 is open. The liquid passes through the liquid solenoid 38 through the check valve 178 into the hot gas pipe "Y" 154 and into the shell of the heat exchanger 142 which serves as a receiver in this mode. The liquid passes out of the heat exchanger 142 (receiver) into the liquid pipe 156 through the ball valve 158 and through the liquid pipe 160 into the coil 162 of the suction accumulator 164. The liquid leaves the coil 162 of the suction accumulator 164, passing by the charge valve 166 through the sighting glass 168, and into the liquid "Y" pipe 170.

The liquid passes through the liquid solenoid 106, the check valve 74 and into the liquid "Y" pipe 72. The liquid solenoid 68 is closed so the liquid passes through the filter/dryers 76 and 78, the thermal expansion valves 80 and 82, into the to the liquid pipe 84 and 96, respectively. The liquid solenoid 92 is closed so the liquid in the pipe 84 passes through the ball valve 86 to the liquid "Y" pipe 88, the evaporators 90 and returns as a cold gas through the cold gas "Y" pipe 108. Similarly, the liquid solenoid 100 is closed so the liquid in the pipe 96 passes through the ball valve 98 to the liquid "Y" pipe 102, the evaporators 104 and returns as a cold gas through the cold gas "Y" pipe 108.

The cold gas solenoid 118 is closed so the cold gas passes through the open cold gas solenoid 110 and the check valve 111 into the cold gas "Y" pipe 172. The cold gas passes from the "Y" pipe 172 into the shell of the suction accumulator 164 and out through the cold gas pipe 174 and back into the compressor 130 through suction dryer 179. A thermostatic bulb 176 of the thermal expansion valve 134 is mounted on the pipe 144.

For circumstances where the system changes from a cascade operation as described above or from a single compressor operation using the compressor 130 to a single compressor operation using the compressor 20, the refrigerant and oil must be cleared from the evaporators before the compressor 20 can supply the evaporators with refrigerant. The liquid solenoids 106 and 110 are closed. The remainder of the solenoids stay in their previous condition as described above. While the compressor 130 still operates, the liquid drain solenoid 100 is opened and the heaters 184 and 186 are energized. The heat from the heaters 184 and 186 boils the refrigerant and oil from the evaporators. The compressor continues to run until a low pressure switch cuts out the compressor which removes essentially all the refrigerant and oil from the system.

In certain cold climate conditions, the ambient temperature surrounding the cooling container is low enough that an insufficient pressure differential exists for the thermal expansion valves to open and feed the liquid refrigerant into the evaporators so that the cooling system will not operate. For such conditions of operation, the heaters 180 and 182 are provided in the base of the receiver and heat exchanger. The appropriate one of the heaters 180 or 182 will operate depending upon which compressor is configured to operate. The heaters are used to heat the liquid to a level for providing sufficient pressure differential to allow the system to start normally. Then the heaters are turned off automatically. In this way, such a container can be used from the hottest to the coldest climates.

Additional heaters 184 and 186 are provided to assist in defrosting of the evaporators 90 and 104, respectively. Under certain cold ambient temperatures, these heaters 184 and 186 can be used to maintain the product temperature higher than the ambient.

Preferably, the solenoids are automatically controlled by an electronic control system. In the preferred embodiment, the controller is a microprocessor. Temperature sensors regulate whether one or the other compressor operates, or both compressors operate as a cascade system depending upon the desired temperature of the load in relation to the ambient temperature.

In operation, the user enters the desired temperature into the controller. Via its sensors, the controller senses the ambient temperature and the desired temperature. The controller calculates a difference value between the desired temperature and the ambient temperature and if beyond a preset threshold, automatically configures the system to operate in cascade mode. Otherwise, it configures the system to operate in single compressor mode using the compressor 20 or 130. If the system determines that one of the compressors is non-functional, it can automatically switch to operation as a single compressor system using the other compressor.

The system described above achieves the goal of providing a broad range of cooling capability over a wide range of ambient temperatures. However, because the two compressors share the evaporators, it is necessary to drain the evaporators whenever the compressor providing liquid to the evaporators changes. Such an embodiment requires additional hardware including solenoids and piping as well as requiring the controller to take additional steps to effect an evacuation of the evaporators. Additionally, because the defrost heaters are energized to boil away even more refrigerant and oil during an evacuation, the added heat temporarily negatively effects the load temperature.

The present invention is directed to a cascade mode refrigeration system that includes two evaporator systems, one for each compressor. Because of the inclusion of the additional evaporator systems, there is no need to evacuate the evaporator systems during a change from one mode to another. Further, the defrost heaters need not be used during such a mode change. Designers having ordinary skill in the art after reading this specification will understand that there are trade-offs in selecting either one of these two inventions; one requires additional control hardware and steps while the other requires additional evaporator systems. A designer will be able to select the system that best suits the needs of the application.

Figure 2A:
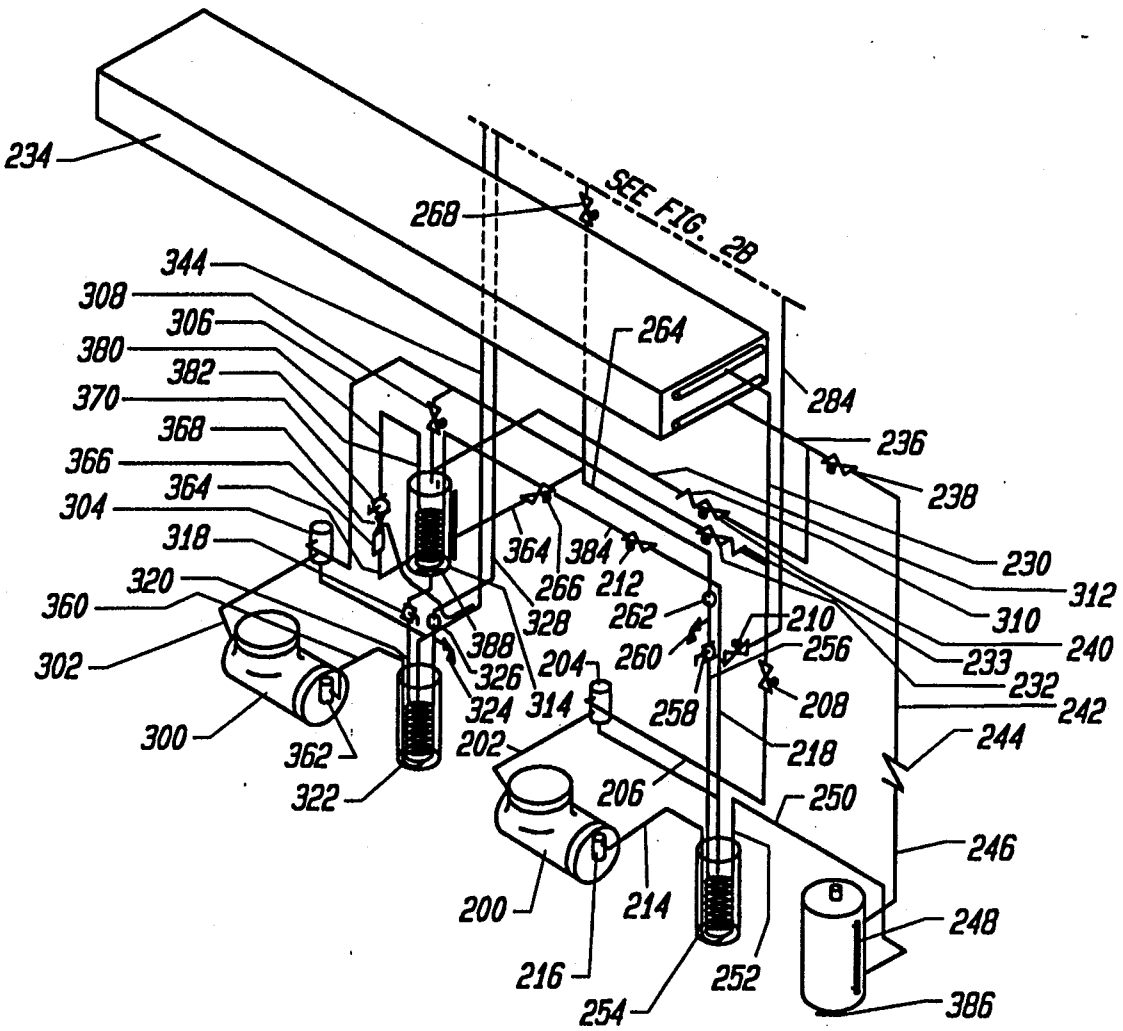
FIG. 2 shows a perspective view of a schematic diagram of the preferred embodiment of the present invention.
Figures 2B, 2C:
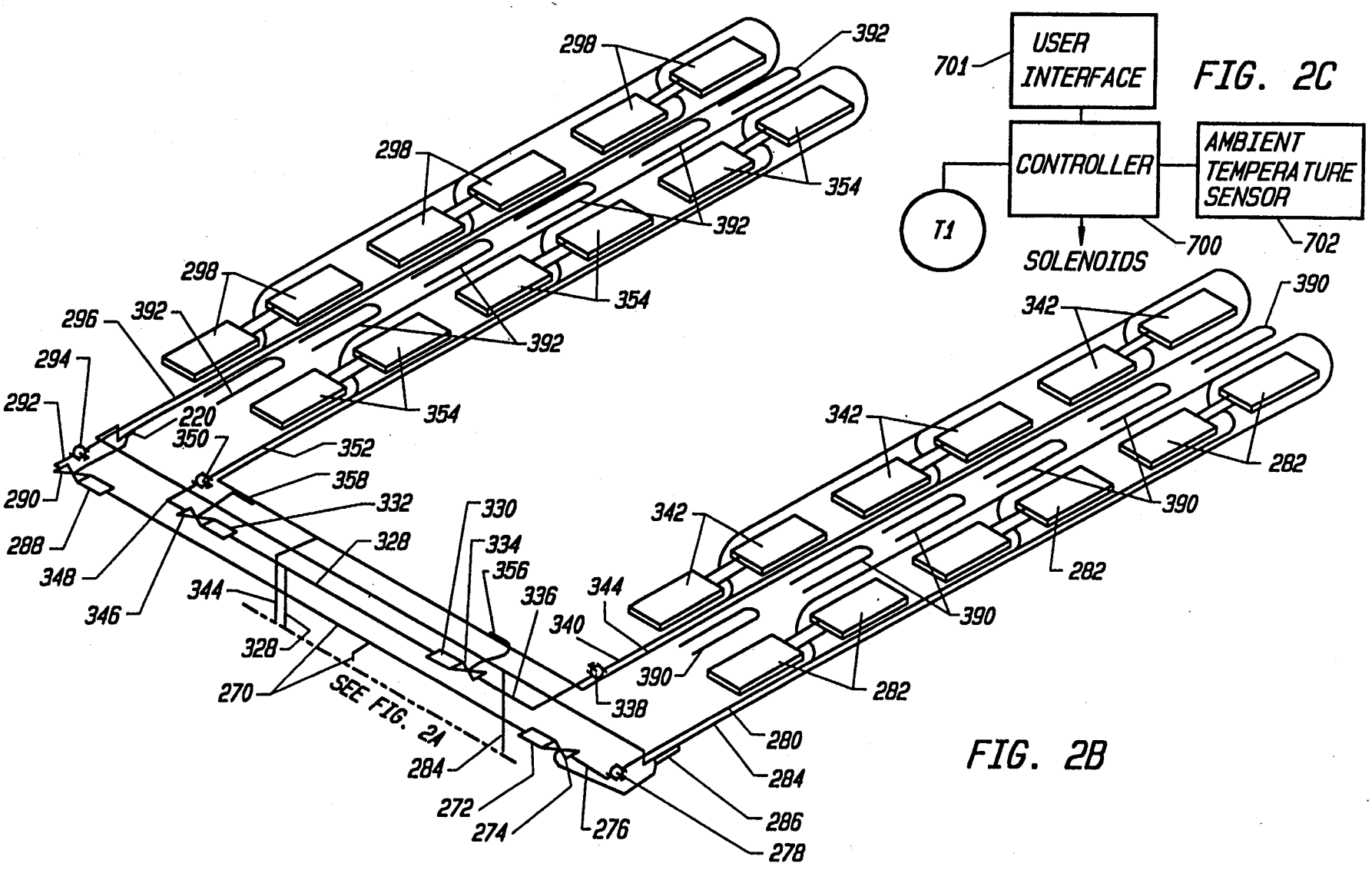

The circuit of FIG. 2 shows the double-circuited evaporator cascade mode refrigeration system of the present invention. This system provides two parallel sets of evaporators so that the refrigerant need not be removed from the evaporators as the system switches between single and/or cascade mode operation. As in the embodiment described above, the present invention is a system configured to operate as two single compressor systems, each one operating at a time, or as cascade cooling system. If the difference between the desired temperature of the product and the ambient temperature is sufficiently small, the apparatus according to that system can automatically configure itself to operate the smaller or the bigger one of the two compressor systems. The two compressor systems preferably have different compressor capacity to provide an even broader range of cooling control. Either compressor can be used in the single compressor mode.

When operating in single compressor mode, a compressor 200 discharges hot gas into a hot gas pipe 202 which is coupled in turn to an oil separator 204. Unless specifically indicated in the description relative to FIG. 2, the cooling system of the present invention of FIG. 2 will operate similarly to the cooling system of the embodiment described above relative to FIG. 1. For example, the oil separator 204 will remove approximately 98% of the oil from the hot gas just like the oil separator 24 of the embodiment of FIG. 1.

The hot gas leaves the oil separator 204 through the hot gas pipe 206 which is coupled to the hot gas solenoid 208. The hot gas solenoid 208 is coupled to a hot gas "Y" pipe 230 and in turn to a hot gas solenoid 232 through check valve 233 which is closed and to a condenser 234. The hot gas gives up heat and is turned to a liquid in the condenser which is coupled out of the condenser 234 to the liquid "Y" pipe 236. The liquid "Y" pipe is coupled to two liquid solenoids 238 and 240. The liquid solenoid 240 is closed, and the liquid solenoid 238 is open coupling the liquid to the liquid pipe 242. The liquid passes through the check valve 244 into the liquid pipe 246, and from there into the linear receiver 248. The liquid passes out of the receiver 248 through the liquid pipe 250 into the coil 252 of the suction accumulator 254.

The liquid leaves the coil 252 of the suction accumulator 254 via the liquid pipe 256, where it passes through the ball valve 258 and the sighting glass 262. A charge valve 260 is coupled to a pipe between the ball valve 258 and the sighting glass 262. The liquid then enters the liquid "Y" pipe 264, which is coupled to the liquid solenoids 266 and 268. Liquid solenoid 266 is closed, and the liquid passes through the open solenoid 268 into the "Y" pipe 270. The "Y" pipe 270 is coupled to the filter dryers 272 and 288. The filter dryer 272 is coupled to the thermal expansion valve 274 which passes the liquid to the pipe 276.

The liquid then passes through the ball valve 278 into the pipe 280, and from there into the evaporators 282. The liquid absorbs heat and thus boils in the evaporators 282 becoming a cold gas which leaves via the cold gas pipe 284. A thermostatic bulb 286 of the thermal expansion valve 274 is mounted on the cold gas pipe 284.

The liquid in the "Y" pipe 270 also passes through the filter dryer 288 and then through the thermal expansion valve 290 into the pipe 292. From there, the liquid passes through the ball valve 294 into the pipe 296, and into the evaporators 298 where it absorbs heat and boils into a cold gas. The cold gas leaves the evaporators 298 via the cold gas pipe 284. A thermostatic bulb 220 of the thermal expansion valve 290 is also mounted on the cold gas pipe 284.

The cold gas pipe 284 is coupled to the solenoid 210. The solenoid 210 is coupled to the "Y" pipe 218 which in turn is coupled to the solenoid 212 and the shell of the suction accumulator 254. The output of the shell of the suction accumulator 254 is coupled to the cold gas pipe 214 which is coupled to a suction dryer 216 and then back to the compressor 200 to complete the single compressor cooling cycle using compressor 200.

In a single compressor cycle using the other compressor, the compressor 300 compresses a gas into a supply of a hot gas which is coupled to a hot gas pipe 302 which in turn is coupled to an oil separator 304. The output of the oil separator 304 is coupled to a hot gas "Y" pipe 306 which is coupled to both the hot gas solenoid 308 which is closed and the solenoid 232 which is open. The hot gas is then coupled to the "Y" pipe 230 wherein the solenoid 208 is closed so the hot gas enters the condenser 234 where it gives up heat to become a liquid. The output of the condenser is coupled to the "Y" pipe 236.

The "Y" pipe 236 is coupled to the solenoid 238 which in turn is closed and the solenoid 240. The solenoid 240 is open so the liquid passes therethrough to the check valve 310 then into the "Y" pipe 312. The "Y" pipe 312 is coupled to the solenoid 308 and to the condenser side of the heat exchanger 314 that in this case serves as a linear receiver and has an output coupled to the liquid pipe 316. The liquid pipe 316 is coupled to the ball valve 318 which in turn is coupled to the coil 320 of the suction accumulator 322. The coil 320 in turn is coupled to a sighting glass 326. A charge valve 324 is coupled to a pipe coupled between the output of the coil 320 and the sighting glass 326. The sighting glass 326 is coupled to a liquid "Y" pipe 328 which in turn is coupled to the filter/dryers 330 and 332.

The filter/dryer 330 is coupled to the thermal expansion valve 334 which passes the liquid to the liquid pipe 336. The liquid is then coupled to the ball valve 338 and then to the liquid "Y" pipe 340 and finally to the evaporators 342 wherein the liquid absorbs heat to become a cold gas. The output of the evaporators 342 is coupled to the cold gas pipe 344. A thermostatic bulb 356 of the thermal expansion valve 330 is mounted on the cold gas pipe 344.

The filter/dryer 332 is coupled to the thermal expansion valve 346 which passes the liquid to the liquid pipe 348. The liquid is then coupled to the ball valve 350 and then to the liquid "Y" pipe 352 and finally to the evaporators 354 wherein the liquid absorbs heat to become a cold gas. The output of the evaporators 354 is coupled to the cold gas pipe 344. A thermostatic bulb 358 of the thermal expansion valve 346 is mounted on the cold gas pipe 344.

The cold gas pipe 344 is coupled to the shell of the suction accumulator 322. The output of the suction accumulator 322 is coupled to a cold gas pipe 360 which in turn is coupled to suction filter 362 and back to the compressor 300 to complete the single compressor cooling cycle using compressor 300.

In the cascade mode, each of the two compressor systems is configured as follows. The compressor 200 discharges hot gas into a hot gas pipe 202 which is coupled in turn to an oil separator 204. Unless specifically indicated in the description relative to FIG. 2, the cooling system of the present invention of FIG. 2 will operate similarly to the cooling system of the embodiment described above relative to FIG. 1. For example, the oil separator 204 will remove approximately 98% of the oil from the hot gas just like the oil separator 24 of the embodiment of FIG. 1.

The hot gas escapes the oil separator 204 through the hot gas pipe 206 which is coupled to the hot gas solenoid 208. The hot gas solenoid 208 is coupled to a hot gas "Y" pipe 230 and in turn to a hot gas solenoid 232 which is closed and to a condenser 234. The hot gas gives up heat and is turned to a liquid in the condenser which is coupled out of the condenser 234 to the liquid "Y" pipe 236. The liquid "Y" pipe is coupled to two liquid solenoids 238 and 240. The liquid solenoid 240 is closed, and the liquid solenoid 238 is open coupling the liquid to the liquid pipe 242. The liquid passes through the check valve 244 into the liquid pipe 246, and from there into the linear receiver 248. The liquid passes out of the receiver 248 through the liquid pipe 250 into the coil 252 of the suction accumulator 254.

The liquid leaves the coil 252 of the suction accumulator 254 via the liquid pipe 256, where it passes through the ball valve 258 and the sighting glass 262. A charge valve 260 is coupled to a pipe between the ball valve 258 and the sighting glass 262. The liquid then enters the liquid "Y" pipe 264, which is coupled to the liquid solenoids 266 and 268. Liquid solenoid 266 is open and the liquid solenoid 268 is closed so the liquid is coupled into a liquid pipe 364 and then into a filter/dryer 366. The filter/dryer 366 is coupled to a thermal expansion valve 368, to a ball valve 370 and then to a liquid pipe 380. The liquid pipe 380 is coupled to a coil 382 of the heat exchanger 314 where it absorbs heat and boils to become a cold gas. The output of the coil 382 is coupled to a cold gas pipe 384 which in turn is coupled to the open cold gas solenoid 212. The solenoid 212 is coupled to the "Y" pipe 218 to which are coupled the closed solenoid 210 and the shell of the suction accumulator 254. As before, the output of the shell of the suction accumulator 254 is coupled to the cold gas pipe 214 which is coupled to a suction filter 216 and then back to the compressor 200 to complete the low cascade compressor cooling cycle using compressor 200.

The upper cascade system is configured so that the compressor 300 compresses a gas into a supply of a hot gas which is coupled to a hot gas pipe 302 which in turn is coupled to an oil separator 304. The output of the oil separator 304 is coupled to a hot gas "Y" pipe 306 which is coupled to both the hot gas solenoid 308 which is open and the solenoid 232 which is closed. The hot gas passes through the solenoid 308 to the "Y" pipe 312 and then condenser side of the heat exchanger 314 which cools the hot gas and condenses it to a liquid. The solenoid 240 is closed.

The condenser side of the heat exchanger 314 has an output coupled to the liquid pipe 316. The liquid pipe 316 is coupled to the ball valve 318 which in turn is coupled to the coil 320 of the suction accumulator 322. The coil 320 in turn is coupled to a sighting glass 326. A charge valve 324 is coupled to a pipe coupled between the output of the coil 320 and the sighting glass 326. The sighting glass 326 is coupled to a liquid "Y" pipe 328 which in turn is coupled to the filter/dryers 330 and 332.

The filter/dryer 330 is coupled to the thermal expansion valve 334 which passes the liquid to the liquid pipe 336. The liquid is then coupled to the ball valve 338 and then to the liquid "Y" pipe 340 and finally to the evaporators 342 wherein the liquid absorbs heat to become a cold gas. The output of the evaporators 342 is coupled to the cold gas pipe 344. A thermostatic bulb 356 of the thermal expansion valve 330 is mounted on the cold gas pipe 344.

The filter/dryer 332 is coupled to the thermal expansion valve 346 which passes the liquid to the liquid pipe 348. The liquid is then coupled to the ball valve 350 and then to the liquid "Y" pipe 352 and finally to the evaporators 354 wherein the liquid absorbs heat to become a cold gas. The output of the evaporators 354 is coupled to the cold gas pipe 344. A thermostatic bulb 358 of the thermal expansion valve 346 is mounted on the cold gas pipe 344.

The cold gas pipe 344 is coupled to the shell of the suction accumulator 322. The output of the suction accumulator 322 is coupled to a cold gas pipe 360 which in turn is coupled to suction dryer 362 and back to the compressor 300 to complete the single low cascade compressor cooling cycle using compressor 300.

In certain cold climate conditions, the ambient temperature surrounding the cooling container is low enough that an insufficient pressure differential exists for the thermal expansion valves to open and feed the liquid refrigerant into the evaporators so that the cooling system will not operate. For such conditions of operation, the heaters 386 and 388 are provided in the base of the receiver and heat exchanger. The appropriate one of the heaters 386 or 388 will operate depending upon which compressor is configured to operate. The heaters are used to heat the liquid to a level for providing sufficient pressure differential to allow the system to start normally. Then the heaters are turned off automatically. In this way, such a container can be used from the hottest to the coldest climates.

Figure 3:
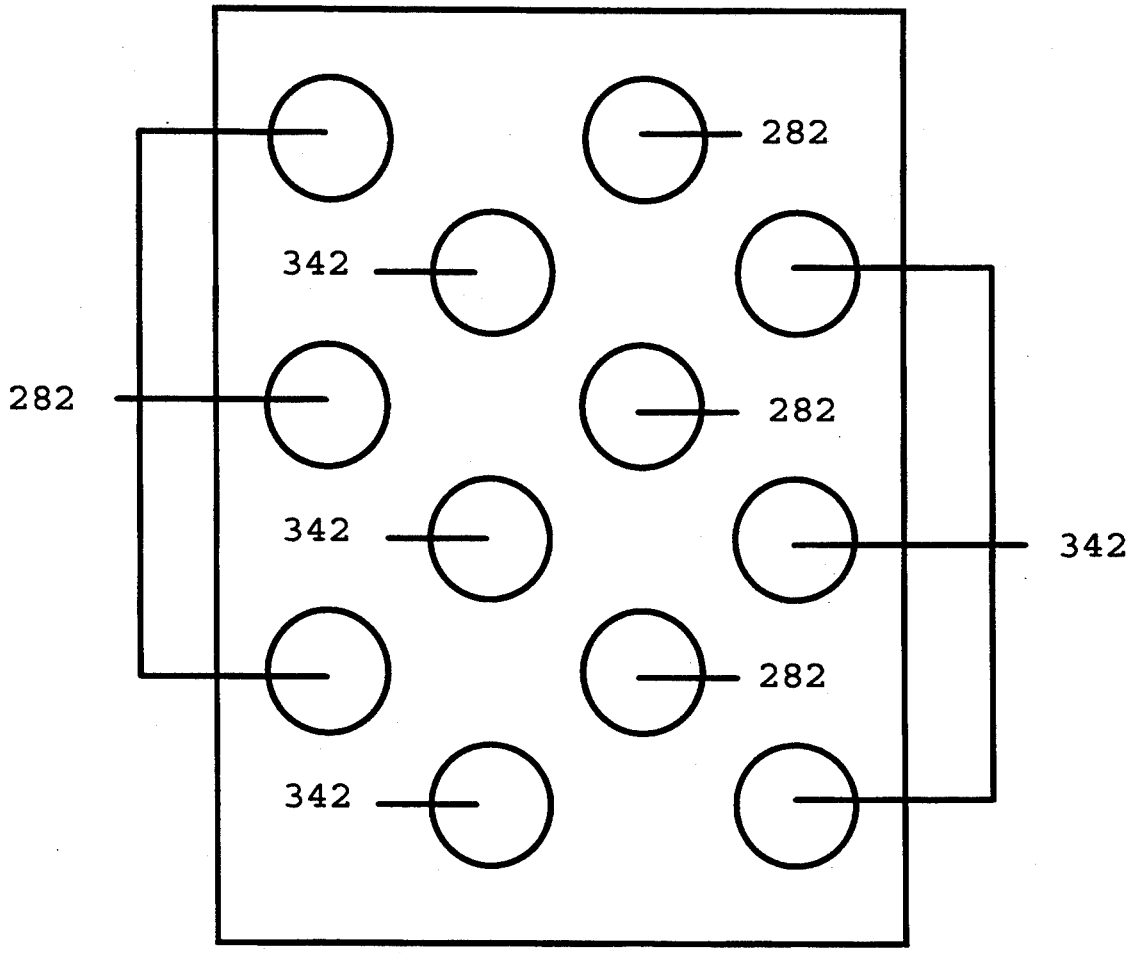
FIG. 3 shows an end section view of a preferred evaporator coil arrangement according to the present invention.

In the preferred embodiment, the evaporators 282 and 342 are interleaved to consume a smaller volume of space as shown in the end section view of FIG. 3. Similarly, the evaporators 298 and 354 are also interleaved. Additional heaters 390 and 392 are provided to assist in defrosting of the interleaved evaporators 282 and 243 as well as the interleaved evaporators 298 and 354, respectively. Under certain cold ambient temperatures, these heaters 390 and 392 can be used to maintain the product temperature higher than the ambient.

Preferably, the solenoids are automatically controlled by an electronic control system 700. In the preferred embodiment, the controller is a microprocessor. Temperature sensors regulate whether one or the other compressor operates, or both compressors operate as a cascade system depending upon the desired temperature of the load in relation to the ambient temperature.

In operation, the user enters the desired temperature through the user interface into the controller. The controller senses the ambient temperature from the ambient temperature sensor 702 and the desired temperature from the user interface 70. The controller calculates a difference value between the desired temperature and the ambient temperature and if beyond a preset threshold, automatically configures the system to operate in cascade mode. Otherwise, it configures the system to operate in single compressor mode using the compressor 200 or 300. If the system determines that one of the compressors is non-functional, it can automatically switch to operation as a single compressor system using the other compressor. A temperature sensor T1 is coupled to the controller to sense the temperature of the load so the control system can control the temperature of the load.

What is claimed is:

1. A cooling system for cooling a product load to a predetermined temperature over a wide range of ambient temperatures comprising:

a. a first compressor coupled to a condenser, a first expansion valve and a first evaporator, b. a second compressor coupled to the condenser, a second expansion valve and a second evaporator; and c. means for selectively operating the first compressor, the second compressor, or both, configured as a cascade system.

2. The cooling system according to claim 1 wherein both compressors use the same refrigerant.

3. The cooling system according to claim 1 further comprising an automatic controller for automatically configuring the system.

4. The cooling system according to claim 3 further comprising:

a. means for entering a desired temperature to the controller;

b. a first temperature sensor coupled to provide temperature data to the controller for sensing an ambient temperature; and c. a second temperature sensor coupled to provide temperature data to the controller for sensing the temperature of a load.

5. The cooling system according to claim 3 further comprising a plurality of solenoids coupled for control by the controller for automatically configuring the system.

6. A cooling system comprising:

a. a first compressor for compressing a first supply of refrigerant into a first supply of hot gas;

b. a heat exchanger having a condenser side and a evaporator side;

c. a first primary evaporator;

d. a second primary evaporator;

e. a second compressor for compressing a second supply of a second supply of refrigerant into a second supply of hot gas;

f. a condenser; and means for selectively coupling the cooling system into any one of at least three configurations including:

(1) a first single compressor system wherein the first compressor is coupled to provide the first supply of hot gas to the condenser for forming a first supply of liquid which is coupled to the first primary evaporator for forming a first supply of cold gas which is returned to the first compressor;

(2) a second single compressor system wherein the second compressor is coupled to provide the second supply of hot gas to the condenser for forming a second supply of liquid which is coupled to the second primary evaporator for forming a second supply of cold gas which is returned to the second compressor; and (3) a cascade compressor system wherein the first compressor is coupled to provide the first supply of hot gas to the condenser side of the heat exchanger for forming a third supply of liquid, the third supply of liquid is coupled to the first primary evaporator for forming a third supply of a cold gas which is returned to the first compressor, the second compressor is coupled to provide the second supply of hot gas to the condenser for forming a fourth supply of liquid, the fourth supply of liquid is coupled to the evaporator side of the heat exchanger for forming a fourth supply of cold gas which is returned to the second compressor.

7. The cooling system according to claim 6 wherein both compressors use the same type of refrigerant.

8. The cooling system according to claim 6 further comprising an automatic controller for automatically configuring the system.

9. The cooling system according to claim 8 further comprising:

a. means for entering a desired temperature to the controller;

b. a first temperature sensor coupled to provide temperature data to the controller for sensing an ambient temperature; and c. a second temperature sensor coupled to provide temperature data to the controller for sensing the temperature of a load.

10. The cooling system according to claim 8 further comprising a plurality of solenoids coupled for control by the controller for automatically configuring the system.

* * * * *

UNITED STATES PATENT AND TRADEMARK OFFICE

CERTIFICATE OF CORRECTION

PATENT NO. : 5,425,244

DATED : June 20, 1995

INVENTOR(S) : Mikhail M. Vaynberg

It is certified that error appears in the above-identified patent and that said Letters Patent is hereby corrected as shown below:

In column 12, line 47, after "interface" please insert --701--.

In column 12, line 50, please delete "70" and replace it with --701--.

In column 13, line 37, before "means" please insert "g.".

Signed and Sealed this

Fifth Day of September, 1995

Bruce Lehman

*Attest:*

BRUCE LEHMAN

*Attesting Officer*

*Commissioner of Patents and Trademarks*